US007267340B2

(12) United States Patent
Hyra et al.

(10) Patent No.: US 7,267,340 B2
(45) Date of Patent: Sep. 11, 2007

(54) WORD-FORMING GAME

(75) Inventors: Matt Hyra, Vista, CA (US); Justin Gary, Carlsbad, CA (US); Daniel Scheidegger, Vista, CA (US)

(73) Assignee: The Upper Deck Company, North Las Vegas, NV (US)

( * ) Notice: Subject to any disclaimer, the term of this patent is extended or adjusted under 35 U.S.C. 154(b) by 0 days.

(21) Appl. No.: 11/414,591

(22) Filed: Apr. 28, 2006

(65) Prior Publication Data

US 2007/0063437 A1 Mar. 22, 2007

Related U.S. Application Data

(60) Provisional application No. 60/718,436, filed on Sep. 19, 2005.

(51) Int. Cl.
*A63F 3/00* (2006.01)

(52) U.S. Cl. ..... 273/272; 273/299

(58) Field of Classification Search ..... 273/272, 273/299; 434/167, 171, 172
See application file for complete search history.

(56) References Cited

U.S. PATENT DOCUMENTS

| | | | | |
|---|---|---|---|---|
| 3,655,195 A | | 4/1972 | Bean et al. | |
| 4,252,323 A | | 2/1981 | Levinrad | |
| 4,331,333 A | | 5/1982 | Willcocks | |
| 4,365,813 A | | 12/1982 | Hirsch | |
| 4,420,157 A | | 12/1983 | White et al. | |
| 4,776,597 A | | 10/1988 | Rudell | |
| 4,819,945 A | | 4/1989 | Porcheddu | |
| 4,896,889 A | | 1/1990 | Kuhn et al. | |
| 4,907,807 A | * | 3/1990 | Lee et al. | 273/240 |
| 5,288,068 A | | 2/1994 | Roth | |
| 5,395,118 A | * | 3/1995 | Barrett | 273/272 |
| 5,429,371 A | * | 7/1995 | Bledsoe | 273/272 |
| 5,520,394 A | | 5/1996 | Brueckner | |
| 5,564,710 A | * | 10/1996 | Bolding et al. | 273/299 |
| 5,615,886 A | * | 4/1997 | Chalfin et al. | 273/272 |
| 5,974,065 A | * | 10/1999 | Kanda | 372/50.23 |
| 6,422,561 B1 | | 7/2002 | Schroeder | |

* cited by examiner

*Primary Examiner*—William M. Pierce
(74) *Attorney, Agent, or Firm*—James P. Broder; Steven G. Roeder

(57) ABSTRACT

A method for playing an interactive game (10) between a first player and a second player includes the steps of the first player obtaining a plurality of active first game pieces (14A) that each includes a word-forming indicia (24A), the first player positioning a first active first game piece (14A) onto one of a plurality of designated positions (22) of a game board (12) to at least partially form a first word, and the second player choosing one of two options. The options can include (i) attempting to identify the first word, and (ii) indicating that the second player does not believe the first player can form any word with the first active first game piece (14A) and the remaining active first game pieces (14A). If the second player chooses the first option, the first player can choose to either (i) admit the second player correctly identified the first word, or (ii) position a second active first game piece (14A) on the game board (12) adjacent to the first active first game piece (14A) to at least partially form a second word. If the second player chooses the second option, the first player can choose to either (i) admit that the first player cannot form any word with the first active first game piece (14A) and the remaining active first game pieces (14A), or (ii) position one or more of the remaining active first game pieces (14A) on the game board (12) to completely form the first word.

25 Claims, 8 Drawing Sheets

WORD-FORMING GAME

RELATED APPLICATION

This Application claims the benefit on U.S. Provisional Application Ser. No. 60/718,436 filed on Sep. 19, 2005. The contents of U.S. Provisional Application Ser. No. 60/718,436 are incorporated herein by reference.

BACKGROUND

Word-forming games that involve spelling of words using game pieced letters on a game board are relatively well-known. In many of these types of games, the success of a player is primarily determined by chance rather than strategy. For example, a player may draw letters that easily combine to form lengthy words, or the player may draw letters that make forming a complete word extremely difficult or impossible. Although some skill and gamesmanship may be involved, the outcome of these types of games is established in large part by "luck of the draw" as opposed to strategic factors. Therefore, it would be desirable to provide a word-forming game that better balances luck inherent with these types of games with strategy considerations that reward a player for tactical play.

SUMMARY

The present invention is directed toward a method for playing an interactive game between a plurality of players including a first player and a second player. In one embodiment, the method includes the steps of the first player obtaining a plurality of active first game pieces that each includes a word-forming indicia, the first player positioning a first active first game piece onto one of a plurality of designated positions of a game board to at least partially form a first word, and the second player choosing one of two options. The options include (i) attempting to identify the first word, and (ii) indicating that the second player does not believe the first player can form any word with the first active first game piece and the remaining active first game pieces.

In one embodiment, the method includes the first player positioning the first active first game piece immediately adjacent to a game piece previously positioned on the game board by another player. Further, the method can include the first player revealing the word-forming indicia on the first active first game piece from the other players only when the first active first game piece is positioned on the game board. The method can also include the step of the first player choosing one of two options after the second player attempts to identify the first word. The options include (i) admitting the second player correctly identified the first word, and (ii) the first player positioning a second active first game piece on the game board adjacent to the first active first game piece to at least partially form a second word.

In another embodiment, the method includes the step of the first player receiving a score based on the number of active first game pieces positioned on the game board by the first player in partially forming the first word, which occurs after the step of the first player admitting. Additionally, the method can include the step of the second player choosing one of two options after the step of the first player positioning a second active first game piece. The options include (i) attempting to identify the second word, and (ii) indicating that the second player does not believe the first player can form any word with the first and second active first game pieces and the remaining active first game pieces. Further, the step of the first player positioning a second active first game piece can include at least partially forming the second word in a direction from the beginning of the second word toward the end of the second word, or the second active first game piece being positioned on the game board to precede the first active first game piece in forming the second word.

In a further embodiment, the method can include the step of the first player choosing one of two options after the step of the second player indicating. The options can include (i) the first player admitting that the first player cannot form any word with the first active first game piece and the remaining active first game pieces, and (ii) the first player positioning one or more of the remaining active game pieces on the game board to completely form the first word. In one embodiment, the method includes after the step of the first player admitting, the first player removing at least the first active first game piece from the game board.

In yet another embodiment, the method can include the step of the first player randomly selecting the plurality of active first game pieces from a pool of inactive first game pieces. Further, the step of the first player positioning can include upon the first player positioning the first active first game piece on a board indicia, various strategic consequences occurring.

The present invention is also directed toward an interactive word-forming game.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
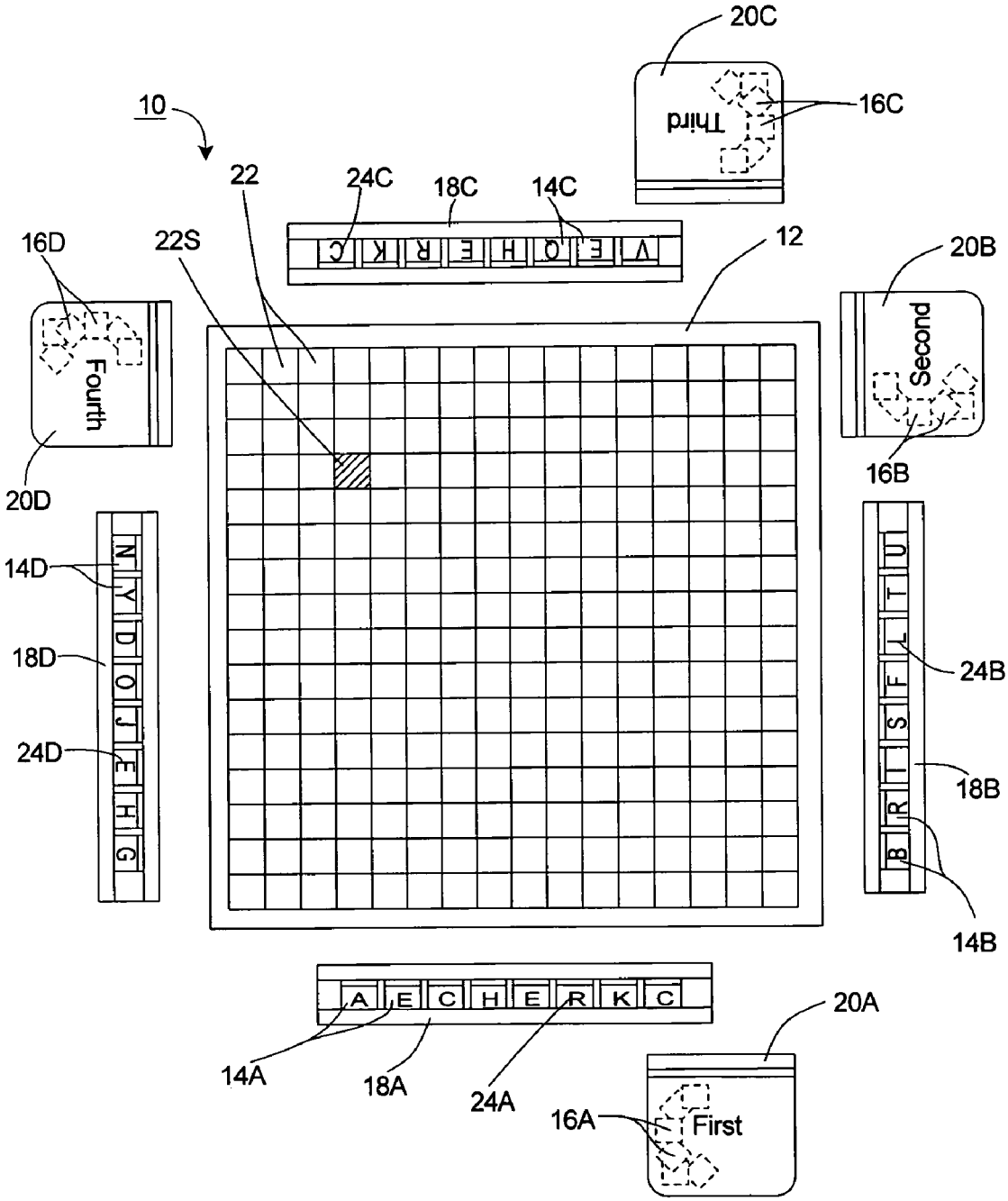
FIG. 1 is a top view of one embodiment of an interactive game having features of the present invention, including a game board, a plurality of active and inactive game pieces, and a plurality of active and inactive game piece retainers.

FIG. 1 illustrates one embodiment of an interactive word-forming game 10 (also sometimes referred to simply as the "game") for use by a plurality of players. In the embodiment illustrated in FIG. 1, the game 10 is arranged for four players. However, it is understood that greater or fewer than four players can play the game 10 at a time, which may require greater or fewer corresponding game structures as set forth herein. Additionally, although the players described herein are referred to as a "first player", a "second player", a "third player" and a "fourth player", it is understood that any of the players can be the first, second, third or fourth player.

In this embodiment, the game 10 includes a game board 12, a plurality of active game pieces 14A-D, a plurality of inactive game pieces 16A-D (illustrated in phantom), a plurality of active game piece retainers 18A-D that retain the active game pieces 14A-D, and a plurality of inactive game piece retainers 20A-D that retain the inactive game pieces 16A-D. The number of active game piece retainers 18A-D and inactive game piece retainers 20A-D used during a particular game typically coincides with the number of players that are playing the game 10. As used herein, the active game pieces 14A-D, the inactive game pieces 16A-D, the active game piece retainers 18A-D, and the inactive game piece retainers 20A-D are collectively termed the "game structures".

The game board 12 includes a plurality of designated positions 22 that each receives one of the active game pieces 16. In the embodiment illustrated in FIG. 1, the game board 12 is arranged in a square 16×16 grid of designated positions 22. However, it is recognized that the game board 12 can be arranged to have different configurations with different dimensions and numbers of designated positions 22. For example, the game board 12 can be rectangular, circular, oval, triangular, trapezoidal, or any other suitable configuration, and can have any number of designated positions 22 consistent with the intent of the game 10 as set forth herein.

Because of the similarity in game structures used by each corresponding player, only the game structures for a first player are described herein, unless otherwise noted. For ease of discussion, as used herein, the game structures for the first player will be termed the active first game pieces 14A, the inactive first game pieces 16A, the active first game piece retainer 18A and the inactive first game piece retainer 20A. For the second player, the game structures will be termed the active second game pieces 14B, the inactive second game pieces 16B, the active second game piece retainer 18B and the inactive second game piece retainer 20B, and so forth, for each of the players.

It is understood that the game structures used by a second player, a third player, etc., are substantially similar or otherwise identical to those used by the first player, with one exception that is present in at least one embodiment. For instance, in one embodiment, certain indicia or other means for identifying the specific game structures belonging to certain players can be present. For example, each player can use game pieces 14A-D, 16A-D having different colors, shapes, logos, fonts, etc., in order to identify which game pieces 14A-D, 16A-D belong to which players. The foregoing examples are representative only and are not intended to limit in any manner the means for identifying or determining which game structures are associated with any of the players. Other than the foregoing exception, the word-forming indicia 24A, the number of first game pieces 14A, 16A, etc., for the first game pieces 14A, 16A can be identical to those of the other game pieces 14B-D, 16B-D.

In one embodiment, the first game pieces 14A, 16A collectively include all of the letters of the alphabet, to varying degrees. For example, the letters that are used most often in a particular language can be more prevalent than letters in the same language that are used less often. In one non-exclusive embodiment, the number of each respective first game pieces 14A, 16A that comprise all of the first game pieces 14A, 16A which include the word-forming indicia 24A (in the English language, for example) set forth below, are as follows:

E=6
A, I, O=5
S=4
L, N, R, T, U=3
B, C, D, F, G, H, M, P, V, W, Y=2
J, K, Q, X, Z=1

Additionally, one or more blank game pieces, e.g., game pieces 14A, 16A with no word-forming indicia, may or may not be included as determined by the players, although the inclusion of blank game pieces is not a requirement of the game 10. In one embodiment, the foregoing word-forming indicia 24A counts are identical for each of the remaining game pieces 14B-D, 16B-D. In an alternative embodiment, the word-forming indicia counts can be disparate between the players in order to level the playing field for players of different abilities or ages. For example, a player of superior ability may use first game pieces 14A, 16A that make it more difficult to form words, while a player of inferior ability may use second game pieces 14B, 16B that facilitate forming of words.

As provided in greater detail below, in one embodiment, a plurality of the active first game pieces 14A are selected by the first player from among the plurality of inactive first game pieces 16A. The active first game pieces 14A are positioned on or in the active first game piece retainer 18A in a manner that allows the first player to view at least a portion, if not all of each of the active first game pieces 14A.

The active first game pieces 14A and inactive first game pieces 16A are collectively described below as the "first game piece(s) 14A, 16A" since there are no structural differences between them. Subject to the exception noted below, each first game piece 14A, 16A includes a word-forming indicia 24A that is recognizable by the first player. For example, each word-forming indicia 24A can be a letter of the alphabet (in any suitable language), as illustrated in FIG. 1. Alternatively, each word forming indicia 24A can include a plurality of letters of the alphabet, such as "PH", "STR", "EA", "QU", etc. Still alternatively, each word-forming indicia 24A can include a phonetic symbol or other icon that represents a letter or a portion of a word. In one embodiment, each first game piece 14A, 16A can have a consistently similar shape and size so that the first player cannot otherwise identify the word-forming indicia 24A on each first game piece 14A, 16A without viewing it.

The active first game piece retainer 18A retains the active first game pieces 14A. The active first game piece retainer 18A can be any suitable device that allows the first player to view the word-forming indicia 24A of each active first game piece 14A while blocking or disallowing the other players from viewing the word-forming indicia 24A. For example, the active first game piece retainer 18A can be a tray or trough that holds the active first game pieces 14A in somewhat of an upright position. However, any suitable device can be used for the active first game piece retainer 18A.

The inactive first game piece retainer 20A retains the inactive first game pieces 16A. The inactive first game piece retainer 20A can be any suitable device that disallows all of the players from viewing the word-forming indicia 24A the inactive first game pieces 16A. For example, the inactive first game piece retainer 20A can be a container that allows the first player to indiscriminately remove inactive first game pieces 16A to become active first game pieces 14A. The container can be a non-see-through bag, for example. However, any suitable container can be used provided the intent of the inactive first game piece retainer 16A as set forth herein is satisfied.

The designated positions 22 on the game board 12 can be delineated by lines appearing on the game board 12, by separate dividers positioned on the game board 12 or by any other suitable means. In one embodiment, each designated position 22 accommodates one active game piece 14A-D. Alternatively, each designated position can accommodate greater than one active game piece 14A-D. As provided in greater detail below, each designated position 22 can include one or more strategic indicia (not shown in FIG. 1), or each designated position 22 can be devoid of any strategic indicia.

Playing the Game

Although it is recognized that the rules of the game can vary widely depending upon the desires of the players, the rules of one embodiment of the game will now be described.

Without looking at the inactive game pieces, each player removes one inactive game piece to determine which player will go first. In one embodiment, a particular criterion is used, such as the player drawing a game piece with a word-forming indicia closest to "A", for example. A set order of player turns is then determined, such as a clockwise order.

Each player then removes a predetermined number of inactive game pieces from the player's inactive game piece retainer so that the pieces become active game pieces. In one embodiment, the number of game pieces removed at the start of the game is eight, although any suitable number of game pieces can be removed as decided on by the players. These now active game pieces are positioned in each player's respective active game piece retainer so that only the player that drew the game pieces can view the word-forming indicia on each game piece.

As an overview, during each players turn, the player attempts to build a word with the game pieces in the player's own active game piece retainer. However, instead of placing active game pieces on the game board all at once to form a word, active game pieces are placed on the game board one at a time. In one embodiment, words are formed either in a left-to-right or a top-to-bottom manner. Further, in one embodiment, the player does not need to state which direction (across or down) that player is forming the word.

The first player begins by placing a first active first game piece on a starting designated position 22S of the game board to at least partially form a first word. The location of the starting designated position can vary from that shown in FIG. 1. In one embodiment, following placement of the first active first game piece, whenever a player places an active game piece on the game board, the active game piece is placed adjacent to another active game piece already positioned on the game board.

After the first player places the first active first game piece, the second player can then choose one of at least two options, including (i) attempting to identify the first word, or (ii) indicating that the second player does not believe the first player can form any word with the first active first game piece and the other active first game pieces. In one embodiment, other players can offer suggestions to the second player, but it is ultimately the second player's decision which of the above options to choose, which can include making the decision on attempting to identify the first word.

If the second player attempts to identify the first word, the first player has at least two options, including (i) the first player indicating that the second player correctly identified the first word, and (ii) the first player positioning a second active first game piece on the game board adjacent to the first active first game piece to at least partially form a second word. In one embodiment, the second word can be the same as the first word. Alternatively, the second word can be different than the first word.

If the first player indicates that the second player correctly identified the first word, the first player receives a score based on the number of active first game pieces placed on the game board in forming the first word. In one embodiment, the first player's score is directly proportional to the number of active first game pieces positioned on the game board by the first player in forming the first word. Alternatively, a multiplier can be used for each active first game piece based on the prevalence of such game piece among all of the active and inactive first game pieces. In another embodiment, active game pieces with certain word-forming indicia can be worth double the score, for example, of the remaining active game pieces. As one non-exclusive example, active game pieces having word-forming indicia of "J", "Q", "X" or "Z" can be worth twice the score of the other active game pieces. Still alternatively, another formula can be used in determining the score of the first player.

In yet another embodiment, no score is taken at that point. Instead, each player keeps track of the total number of active game pieces for that player which are positioned on the game board. When the total number of active game pieces on the game board for a particular player reach a predetermined number, such as 20, for example, that player is the winner and the game ends. The predetermined number of active game pieces required to win the game can be varied to either lengthen or shorten the duration of the game.

In the event the first player receives a score in at least partially forming the first word, the first player's turn ends. When the first player's turn ends, another player begins a turn in a substantially similar manner as the first player's turn, with the exception that the new turn does not begin at the starting designated position. Instead, the new turn begins by placement of an active game piece adjacent to one of the active game pieces already positioned on the game board.

If the first player chooses the second option and positions a second active first game piece on the game board to partially form a second word, the second player again chooses one of two options, including (i) attempting to identify the second word, or (ii) indicating that the second player does not believe the first player can form any word with the first and second active first game pieces and the other active first game pieces.

In the event the second player chooses the second option above, indicating that the second player does not believe the first player can form any word with the first active first game piece and the other active first game pieces, the first player then chooses between two options. These options include (i) the first player admitting that the first player cannot form any word with the first active first game piece and the remaining active first game pieces, and (ii) the first player positioning one or more of the remaining active first game pieces on the game board to completely form the first word.

If the first player chooses to admit that the first player cannot form any word with the first active first game piece and the remaining active first game pieces, the first player is penalized and must remove one or more active game pieces from the game board. In one such embodiment, the first player removes one active game piece from the word currently being formed by the first player. Alternatively, the first player removes up to two active game pieces from the word currently being formed. Still alternatively, the number of active game pieces that are removed can be greater than two.

Once the first player removes one or more active game pieces from the game board, the first player's turn ends, and another player's turn begins substantially similarly to the turn of the first player.

In one embodiment, if the first player chooses to position one or more of the remaining active first game pieces on the game board to completely form the first word, the first player receives a score based on the number of active first game pieces placed on the game board in forming the first word in a similar manner as described above. Alternatively, no score is taken at that point, and the players keep track of the number of active game pieces each has on the game board until a predetermined number is reached, as described above.

The game proceeds in this manner, each player taking turns, until one of the players attains a predetermined score, i.e. until a predetermined number of active game pieces for a particular player are positioned on the game board.

Figure 2A:
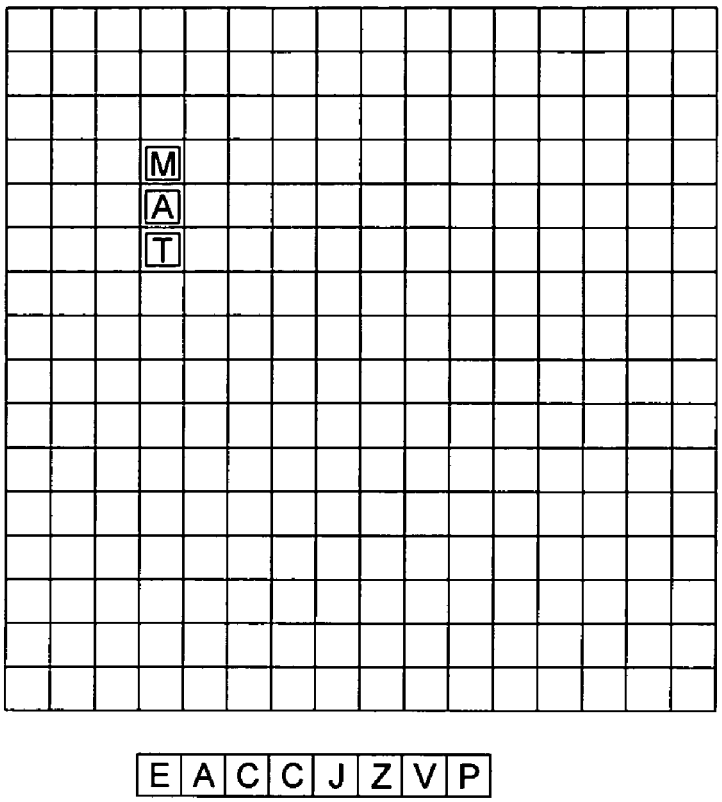
FIG. 2A is a top view of one embodiment of a portion of the interactive game at a first point during the turn of a first player.

Referring to FIG. 2A, rules in addition to the rules provided above can be incorporated into the game. In one embodiment, once a player attempts to identify a word being formed by another player, the identified word can no longer be formed on that turn. For example, assume the first player has active first game pieces with the following word-forming indicia: E, A, C, C, J, Z, V and P. As illustrated in FIG. 2A, an active game piece having the word-forming indicia "T" is on the game board.

Figure 2B:
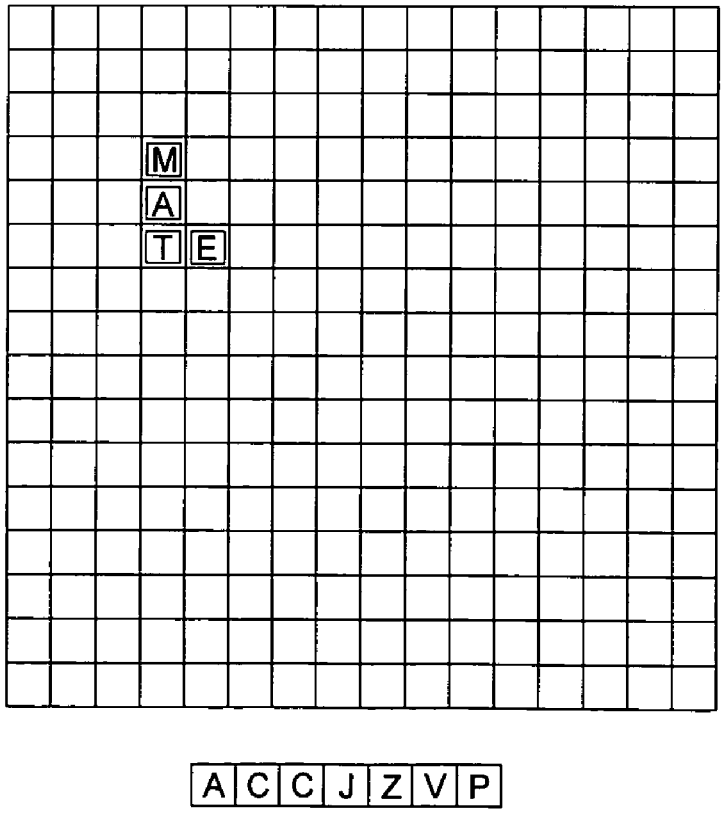
FIG. 2B is a top view of the interactive game illustrated in FIG. 2A at a second point during the turn of the first player.

Referring to FIG. 2B, the first player places a first active first game piece with the word-forming indicia "E" to the right of the "T". The second player attempts to identify the first word, and guesses "TEAM." The first player could end his/her turn here and say that "TEAM" was the first word. But the first player would like to get the "A" into play, so the first player continues. However, the first player cannot complete the word "TEAM" now (even if the first player could), because "TEAM" has already been guessed by the second player.

Figure 2C:
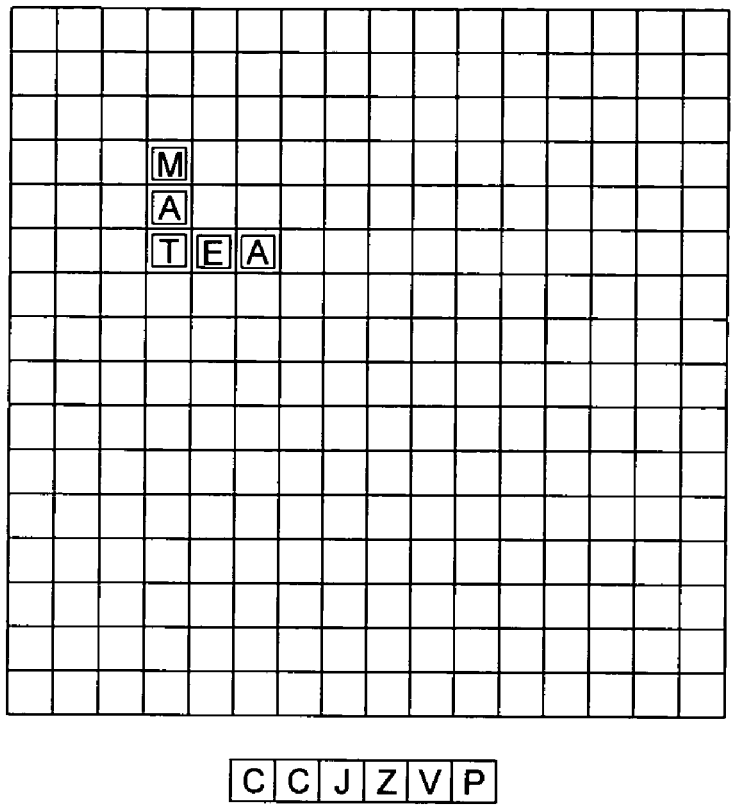
FIG. 2C is a top view of the interactive game illustrated in FIG. 2A at a third point during the turn of the first player.

Referring to FIG. 2C, the first player then positions a second active first game piece having word-forming indicia "A". The second player attempts to identify the word as "TEAR." Even though the first player does not have active game pieces that include word-forming indicia to spell the word "TEAR", the first player could claim that the second player was correct in identifying the word, and can end the first player's turn at "TEA". Alternatively, the first player has active game pieces that include word-forming indicia to almost form the word "TEACH".

Figure 2D:
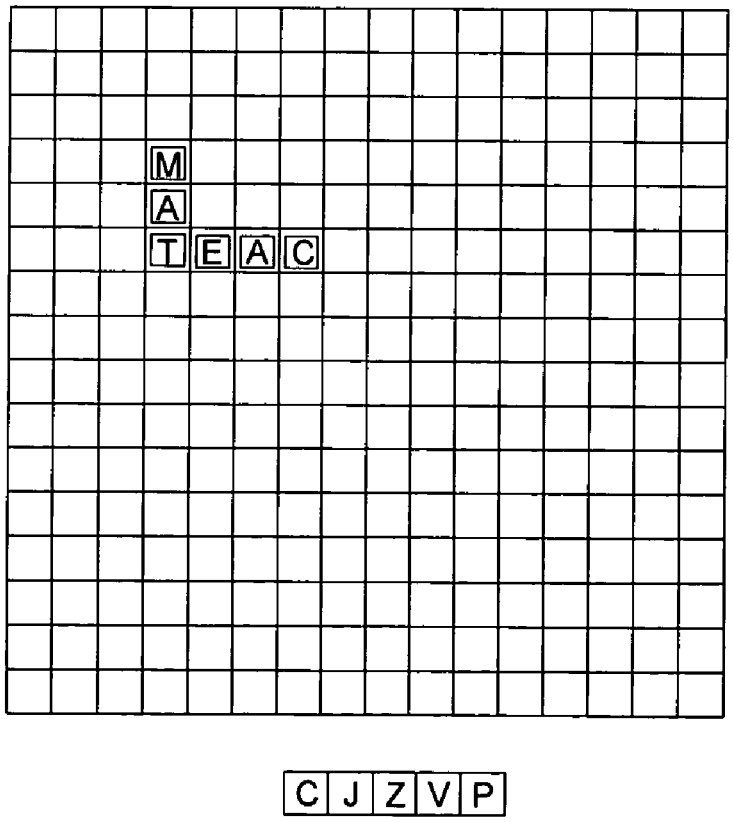
FIG. 2D is a top view of the interactive game illustrated in FIG. 2A at a fourth point during the turn of the first player.

Referring to FIG. 2D, the first player states that the second player's attempt to identify the word is incorrect by positioning a third active first game piece having word-forming indicia "C". Thus, although the first player does not have further active game pieces to complete a word, the first player can bluff that he/she does. The second player then identifies the word "TEACH" as the word the second player believes the first player is forming. The first player can then claim that the second player is correct and can end the first player's turn. The first player has successfully placed three active first game pieces onto the board (and an incomplete word) toward achieving the predetermined objective of reaching 20 active game pieces in a two-player game, in one non-exclusive example, or 15 active game pieces in a four-player game as another non-exclusive example.

However, in the above example, if the second player doesn't believe the first player has an active game piece with word-forming indicia "H" (or any other word-forming indicia that could complete a word), instead of identifying "TEACH", the second player could indicate that he/she does not believe the first player can form any word with the first, second and third active first game pieces and the remaining active first game pieces. If the second player does so, in one embodiment, the first player either completes the word or gets caught in the bluff.

In the event the first player is caught in the bluff, the first player must remove at least the last active game piece played by the first player this turn from the game board and place it in the inactive first game piece retainer. In another embodiment, the first player must remove more than of the active first game pieces positioned on the game board during the first player's turn. The first player also restocks the active first game piece retainer up to total eight active first game pieces.

In the event the second player indicates that he/she does not believe the first player can form any word with the first, second and third active first game pieces and the remaining active first game pieces, and the second player is incorrect, the first player can place the remaining active first game pieces to form the word with no further guessing by any other player allowed during this turn.

Referring to FIG. 2D, for example, assume the second player indicates that he/she does not believe the first player can form any word with the first, second and third active first game pieces and the remaining active first game pieces. The first player can then position fourth, fifth and sixth active first game pieces that include word-forming indicia "H", "E", and "R", respectively, to form the word "TEACHER" with no further guesses by any player allowed during this turn.

Figure 3A:
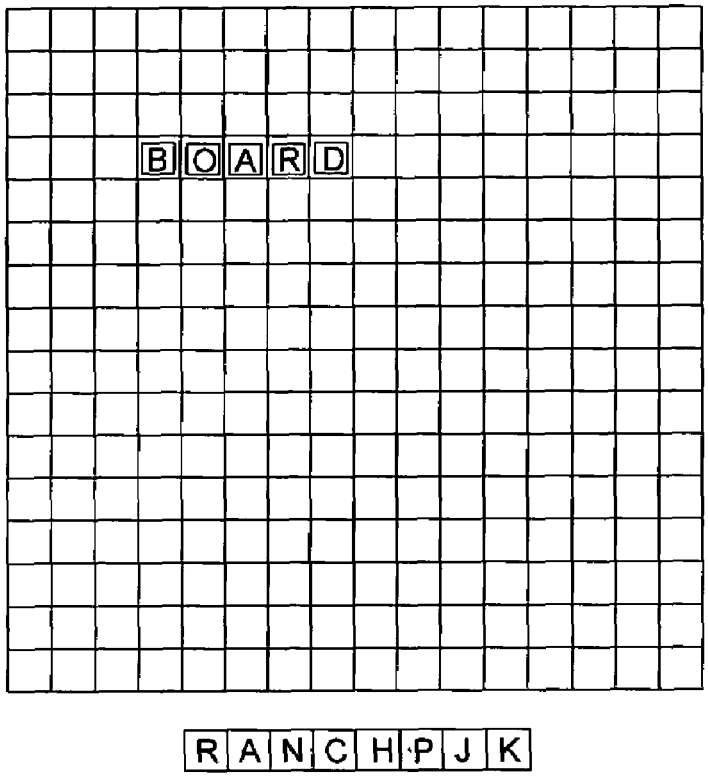
FIG. 3A is a top view of one embodiment of a portion of the interactive game at a first point during the turn of a first player.
Figure 3B:
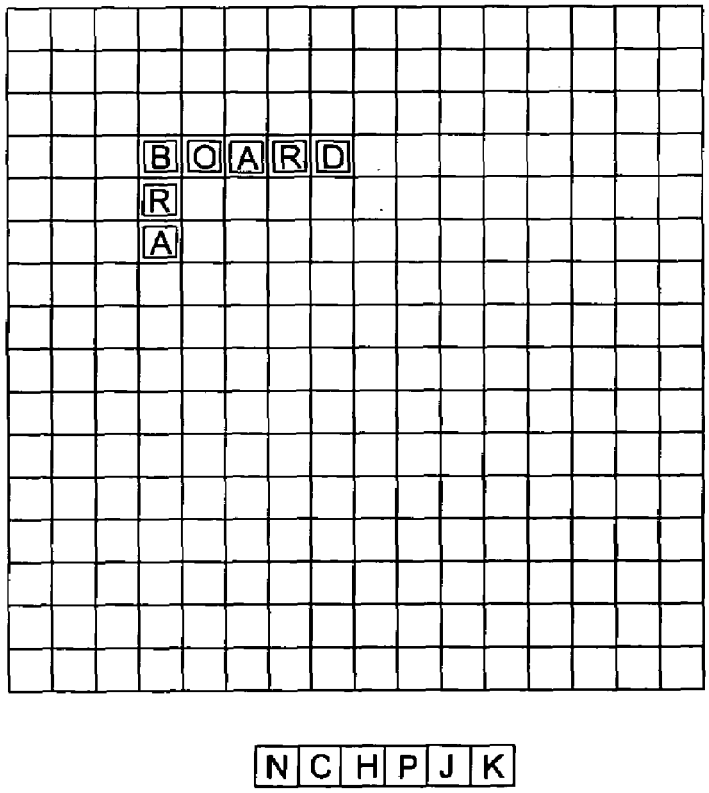
FIG. 3B is a top view of the interactive game illustrated in FIG. 3A at a second point during the turn of the first player.
Figure 3C:
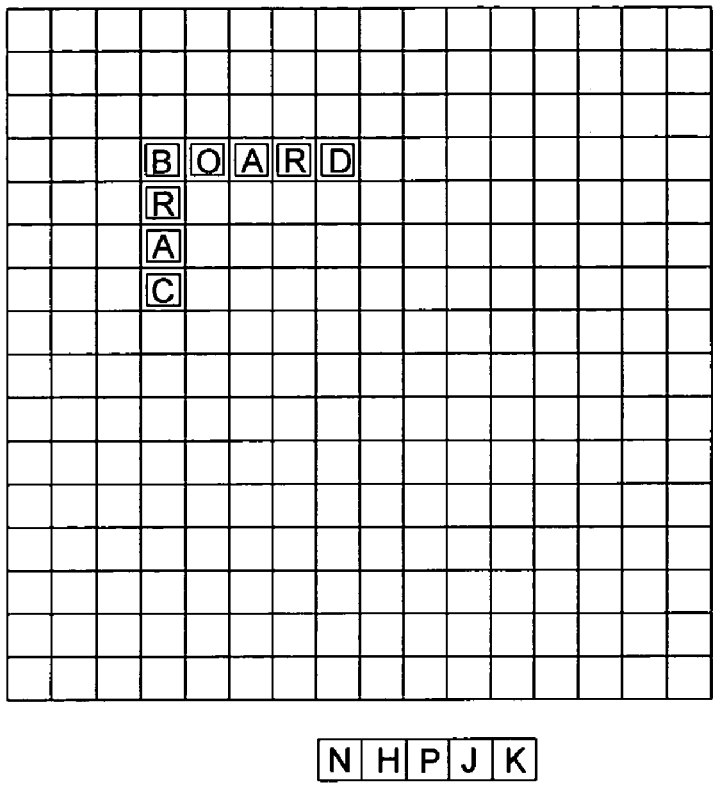
FIG. 3C is a top view of the interactive game illustrated in FIG. 3A at a third point during the turn of the first player.

FIGS. 3A-3C illustrate a further rule that, in one embodiment, can be added to the above rules. The first player cannot form a word on the board that has already been guessed by another player (e.g., the second player), even if the first player is on the way to forming a longer word.

Referring to FIG. 3A, assuming the first player has active first game pieces with word-forming indicia as follows: R, A, N, C, H, P, J and K. A previously-positioned active game piece with word-forming indicia "B" is already positioned on the game board. Using that "B", the first player can potentially form "BRANCH".

FIG. 3B illustrates the game board after the first player positions active first game pieces with word-forming indicia "R" and "A". The second player then attempts to identify the first word as being "BRAN". The first player cannot now play the active first game piece with word-forming indicia "N" onto the game board, as that word has already been guessed and playing the "N" would form "BRAN". Even though the first player intended to spell "BRANCH", the first player cannot now place the "N".

However, as illustrated in FIG. 3C, not satisfied with just two active first game pieces this turn, the first player can position an active first game piece having word-forming indicia "C" on the game board. The first player does not even need to know what word he/she might be forming, but the first player can bluff nonetheless. The second player attempts to identify the word as "BRACE". The first player can indicate that the second player has correctly identified the word the first player was going to form (even if this is not true). The first player's turn then ends, and the first player has successfully bluffed a third active first game piece onto the game board. Had the second player indicated that he/she did not believe the first player, the first player would have had to remove at least the active first game piece having word-forming indicia "C" from the game board (or additional active game pieces as well).

In one embodiment, whenever a player has a predetermined number (e.g., 20) of active game pieces on the game board, the game ends at the end of the current round. Once the last player has taken his/her turn, if one or more players still have at least the predetermined number of active game pieces on the board the player with the most active game pieces on the game board is the winner.

FIGS. 4A-4D illustrate various additional rules that can be incorporated into the present game. As an overview, while each active game piece positioned on the game board by a given player during a turn must be adjacent to a previously positioned active game piece on the game board, a word can be formed in either or both directions. In one embodiment, when a player positions an active game piece on the game board, the player does not have to indicate where the particular word-forming indicia on the active game piece falls in the word.

Figure 4A:
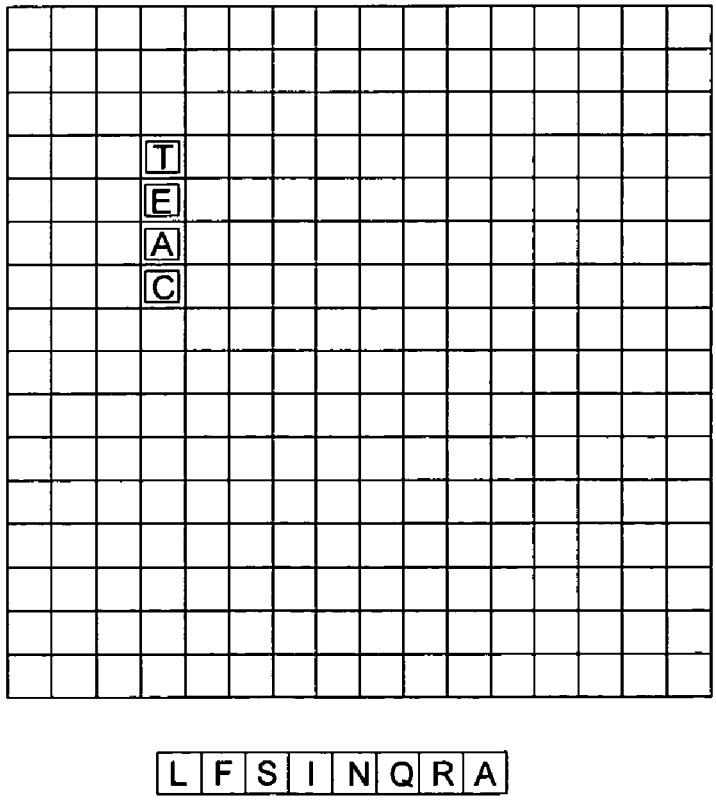
FIG. 4A is a top view of one embodiment of a portion of the interactive game at a first point during the turn of a first player.
Figure 4B:
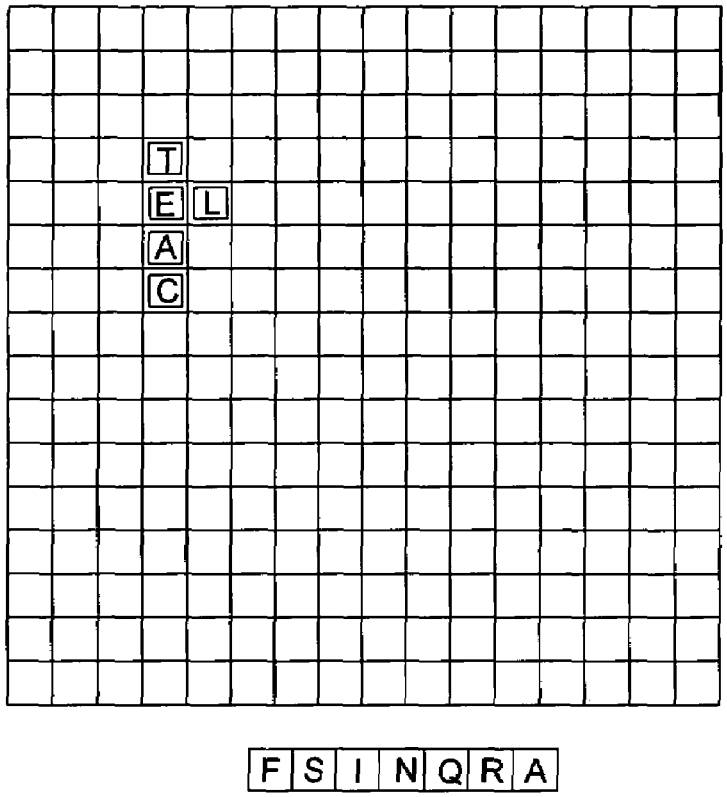
FIG. 4B is a top view of the interactive game illustrated in FIG. 4A at a second point during the turn of the first player.
Figure 4C:
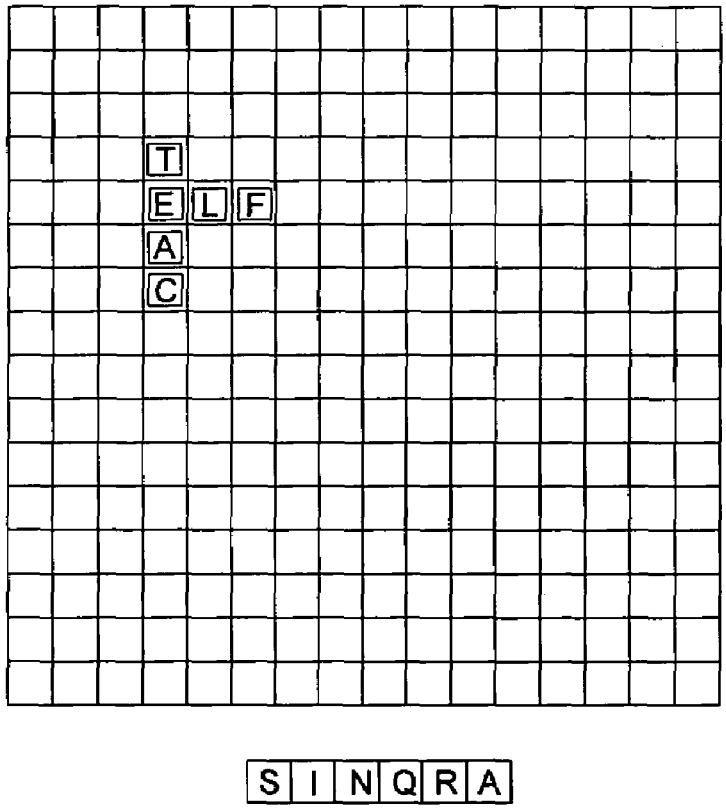
FIG. 4C is a top view of the interactive game illustrated in FIG. 4A at a third point during the turn of the first player.
Figure 4D:
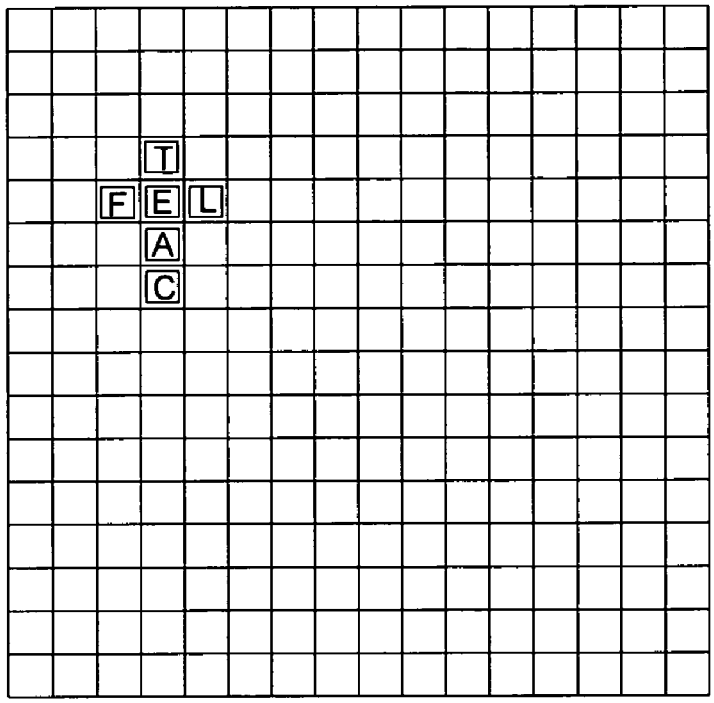
FIG. 4D is a top view of the interactive game illustrated in FIG. 4A at a fourth point during the turn of the first player.

FIG. 4A illustrates the partial word "TEAC" is on the game board vertically. In FIG. 4B, the first player has positioned a first active first game piece having word-forming indicia "L" to the right of the "E". In this example, the "E" could be the first letter in the word being formed, or not. FIG. 4C illustrates that the first player can position a second active first game piece having word-forming indicia "F" on the board to the right of the "L" to form the word "ELF". FIG. 4D illustrates that the first player could alternatively position the "L" to the left of the "E", to form the partial word "FEL". If the first player has not completed the word, then the second player must try to determine if the first player is forming "ELFIN", "SELF", or if the first player is bluffing.

Figure 5:
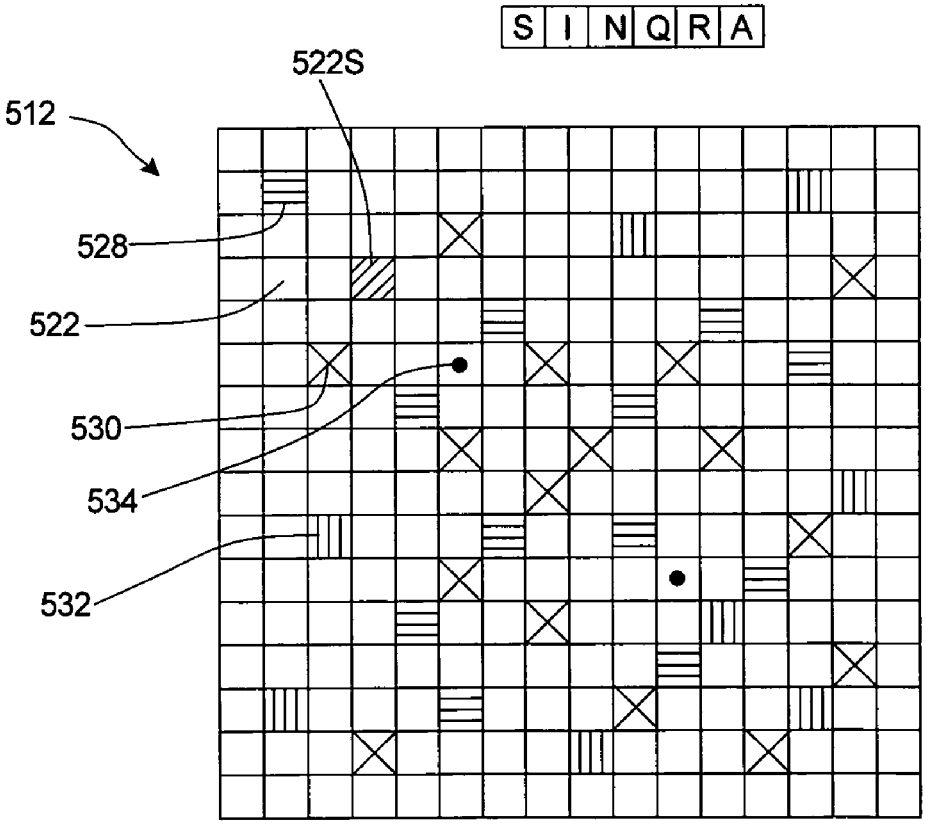
FIG. 5 is a top view of another embodiment of the game board.

FIG. 5 illustrates that one or more of the designated positions 522 on the game board 512 can include board indicia that can influence the outcome of a turn, a round or the game. In one embodiment, one or more different types of board indicia can be positioned on various designated positions 522 on the game board 512 as illustrated in FIG. 5. For example, in addition to the starting designated position 522S described previously, the board indicia can include one or more of a first board indicia 528, a second board indicia 530, a third board indicia 532 and a fourth board indicia 534.

In one embodiment, whenever an active game piece is positioned on the game board 512, the player positioning the active game piece checks to see if the active game piece was placed on top of a board indicia 528, 530, 532, 534. If so, the player performs the designated function of the board indicia. It is recognized that the following example of various board indicia is provided for representative purposes and ease of discussion, and is not intended to limit the scope of the present invention in any manner. Further, although the first player is often referred to, it is understood that any player can be the first player and that this reference is used for ease of understanding only.

Referring to FIGS. 1 and 5, in one embodiment, the first board indicia 528 can entitle the first player to take up to two active first game pieces 14A from the active first game piece retainer 18A and place them into the inactive first game piece retainer 20A. For each active first game piece 14A placed into the inactive game piece retainer 20A, a new inactive game piece 16A can be drawn from the inactive game piece retainer 20A and placed into the active game piece retainer 18A, thereby activating the game piece. Stated another way, the first player can exchange one active first game piece 14A for an inactive first game piece 16A.

The second board indicia 530 can entitle the first player to draw inactive first game pieces 16A from the inactive first game piece retainer 20A and place them into the active first game piece retainer 18A until eight (or some other predetermined number) active first game pieces 14A are positioned in the active first game piece retainer 18A.

The third board indicia 532 can entitle the first player to choose a second player and one active second game piece 14B of the second player at random. The second player then returns that active second game piece 14B to the inactive second game piece retainer 20B (illustrated in FIG. 1), and will start his/her next turn with less than eight active second game pieces 14B.

The fourth board indicia 534 can entitle the first player to remove a previously placed active second game piece 14B of the second player (for example) from the game board 512 and place it into the inactive second game piece retainer 20B. In one embodiment, the fourth board indicia 534 entitles the first player to the above-described action only when an active first game piece remains on the fourth board indicia 534 at the end of the first player's turn. Alternatively, the above-described action can occur anytime an active first game piece is placed on top of the fourth board indicia 534.

One or more of the following additional rules can also be incorporated into the rules of the game.

For example, if the second player does not identify the word the first player is forming before the first player finishes forming it, the first player can announce that the word is complete to the other players before they take any further action. The first player's turn is then over.

Further, all attempts to identify a word must include actual words with three or more word-forming indicia.

Players may continue forming a previously-positioned partial word (by any player) on the game board, or make a word on the game board plural.

When forming a word that is parallel to another previously-positioned word on the game board, the player does not have to make words out the adjacent word-forming indicia of the two words.

When attempting to identify a word, the player must spell the word if it sounds like any other word. For example, if a player attempts to identify the word "TEA", the player must spell it T-E-A to distinguish it from the word T-E-E.

If a player finishes a word that turns out not to be a legal word (like a proper name or a misspelled word), the player must remove all the active game pieces placed during the player's turn and place them in that player's inactive game piece retainer.

A player may pass that player's turn and swap two active game pieces for two inactive game pieces. If four players pass in a row, the game ends immediately and the player with the most active game pieces on the game board wins.

Figure 6:
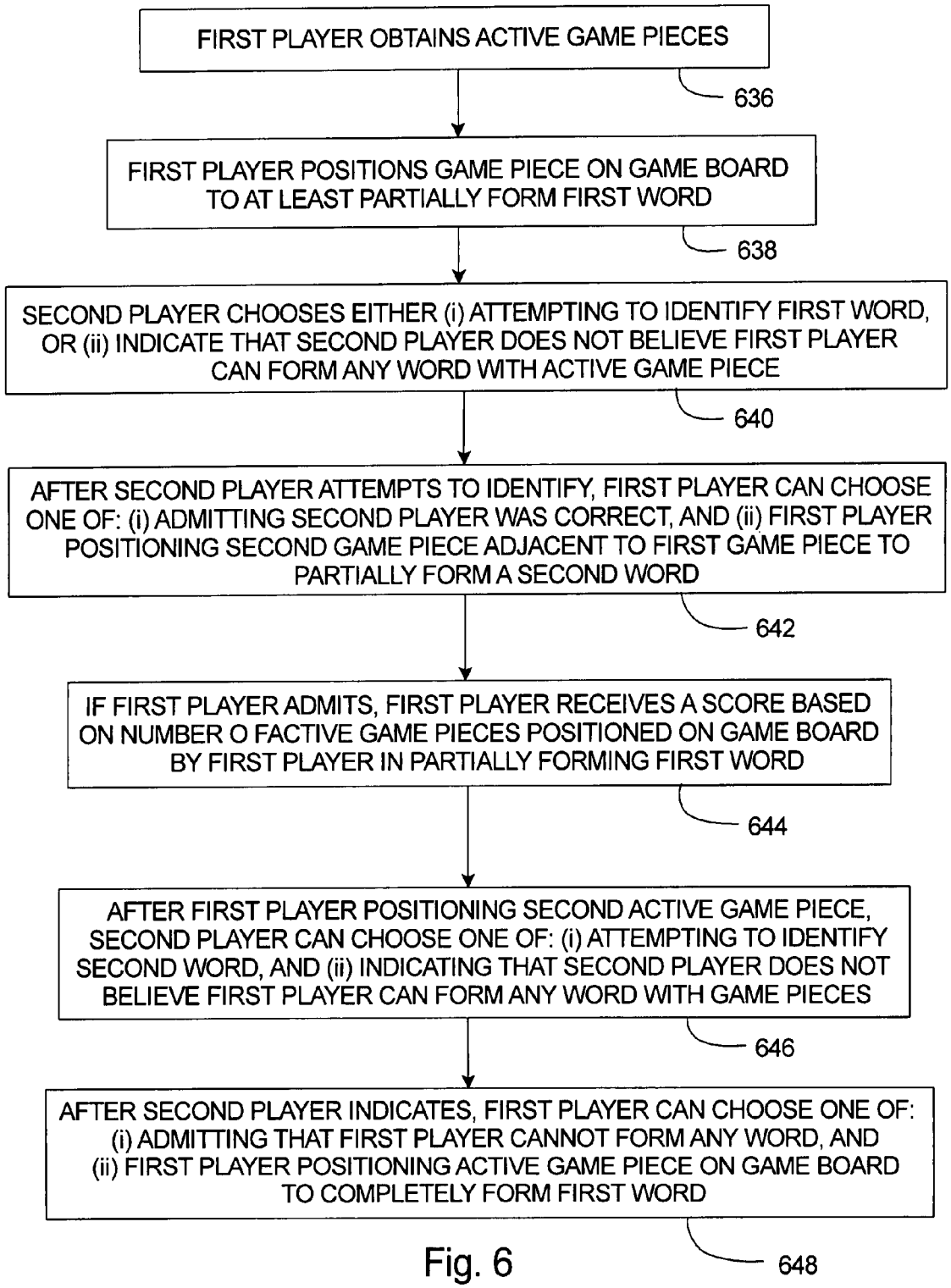
FIG. 6 is a flow chart depicting one embodiment of a method for playing the interactive game.

FIG. 6 is a flow chart depicting a method for playing the interactive game. It is recognized that not all of the steps illustrated in FIG. 6 need to be included in the interactive game. The steps are provided as one example of steps that can be included in one or more embodiments of the interactive game.

For example, in some embodiments, the first player obtains a plurality of active first game pieces that each includes a word-forming indicia at step 636. In one embodiment, the first player can reveal the word-forming indicia on the first active first game piece from the other players only when the first active first game piece is positioned on the game board. In another embodiment, the first player can randomly select the plurality of active first game pieces from a pool of inactive first game pieces.

At step 638, the first player can position a first active first game piece onto one of a plurality of designated positions of a game board to at least partially form a first word. In one embodiment, step 638 can include the first player positioning the first active first game piece immediately adjacent to an active game piece previously positioned on the game board by another player. The first word can include the first active first game piece and the previously positioned active game piece. In one embodiment, upon the first player positioning the first active first game piece on a board indicia on one of the designated positions, the first player can exchange one active first game piece for one inactive first game piece. Alternatively, upon the first player positioning the first active first game piece on a board indicia on one of the designated positions. the first player can reduce the number of active second game pieces of the second player.

In certain embodiments, the second player can choose one of two steps to take at step 640, including (i) attempting to identify the first word, and (ii) indicating that the second player does not believe the first player can form any word with the first active first game piece and the remaining active first game pieces. In one embodiment, after the step of the second player attempting to identify the first word at step 640, the method can include the step of the first player choosing one of two steps to take at step 642, including (i) admitting the second player correctly identified the first word, and (ii) the first player positioning a second active first game piece on the game board adjacent to the first active first game piece to at least partially form a second word.

In one embodiment, after the step of the first player admitting at step 642, the method can include the step of the first player receiving a score based on the number of active first game pieces positioned on the game board by the first player in partially forming the first word, at step 644. In this embodiment, the second player can then position a first active second game piece onto one of the plurality of designated positions of the game board to at least partially form a second word.

In another embodiment, after the step of the first player positioning a second active first game piece at step 642, the method can include the step of the second player choosing one of two steps to take at step 646, the steps including (i) attempting to identify the second word, and (ii) indicating that the second player does not believe the first player can form any word with the first and second active first game pieces and the remaining active first game pieces.

In certain embodiments, after the step of the second player indicating at step 646, the method can include the step of the first player choosing one of two steps to take at step 648, the steps including (i) the first player admitting that the first player cannot form any word with the first active first game piece and the remaining active first game pieces, and (ii) the first player positioning one or more of the remaining active first game pieces on the game board to completely form the first word.

While the particular interactive word-forming game 10 as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for playing an interactive game between a plurality of players including a first player and a second player, the method comprising the steps of:

the first player obtaining a plurality of active first game pieces that each includes a word-forming indicia;

the first player positioning a first active first game piece onto one of a plurality of designated positions of a game board to at least partially form a first word; and the second player choosing one of two steps to take, the steps including (i) attempting to identify the first word, and (ii) indicating that the second player does not believe the first player can form any word with the first active first game piece and the remaining active first game pieces.

2. The method of claim 1 wherein the step of the first player positioning includes the first player positioning the first active first game piece immediately adjacent to an active game piece previously positioned on the game board by another player.

3. The method of claim 2 wherein the first word includes the first active first game piece and the previously positioned active game piece.

4. The method of claim 1 wherein the step of the first player obtaining includes the first player revealing the word-forming indicia on the first active first game piece from the other players only when the first active first game piece is positioned on the game board.

5. The method of claim 1 wherein after the step of the second player attempting to identify the first word, the method further comprises the step of the first player choosing one of two steps to take, the steps including (i) admitting the second player correctly identified the first word, and (ii) the first player positioning a second active first game piece on the game board adjacent to the first active first game piece to at least partially form a second word.

6. The method of claim 5 wherein after the step of the first player admitting, the method further comprises the step of the first player receiving a score based on the number of active first game pieces positioned on the game board by the first player in partially forming the first word.

7. The method of claim 6 wherein after the step the first player receiving a score, the method further comprises the step of the second player positioning a first active second game piece onto one of the plurality of designated positions of the game board to at least partially form a second word.

8. The method of claim 5 wherein after the step of the first player positioning a second active first game piece, the method further comprises the step of the second player choosing one of two steps to take, the steps including (i) attempting to identify the second word, and (ii) indicating that the second player does not believe the first player can form any word with the first and second active first game pieces and the remaining active first game pieces.

9. The method of claim 5 wherein the step of the first player positioning a second active first game piece includes at least partially forming the second word in a direction from the beginning of the second word toward the end of the second word.

10. The method of claim 5 wherein the step of the first player positioning a second active first game piece includes the second active first game piece being positioned on the game board to precede the first active first game piece in forming the second word.

11. The method of claim 10 wherein the second active first game piece includes a word-forming indicia that precedes the word-forming indicia of the first active first game piece in the second word.

12. The method of claim 5 wherein the second word is different than the first word.

13. The method of claim 5 wherein the second word is the same as the first word.

14. The method of claim 1 wherein after the step of the second player indicating, the method further comprises the step of the first player choosing one of two steps to take, the steps including (i) the first player admitting that the first player cannot form any word with the first active first game piece and the remaining active first game pieces, and (ii) the first player positioning one or more of the remaining active first game pieces on the game board to completely form the first word.

15. The method of claim 14 wherein after the step of the first player admitting, the method further comprises the step of the first player removing at least the first active first game piece from the game board.

16. The method of claim 15 wherein after the step the first player removing, the method further comprises the step of the second player positioning a first active second game piece onto one of the plurality of designated positions of the game board to at least partially form a third word.

17. The method of claim 14 wherein after the step of the first player positioning one or more of the remaining active first game pieces on the game board to form the second word, the method further comprises the step of the first player receiving a score based on the number of active first game pieces positioned on the game board by the first player in forming the first word.

18. The method of claim 1 wherein the step of the first player obtaining includes the first player randomly selecting the plurality of active first game pieces from a pool of inactive first game pieces, and wherein the step of the first player positioning includes upon the first player positioning the first active first game piece on a board indicia on one of the designated positions, the first player exchanging one active first game piece for one inactive first game piece.

19. The method of claim 1 wherein the step of the first player obtaining includes the first player randomly selecting the plurality of active first game pieces from a pool of inactive first game pieces, and wherein the step of the first player positioning includes upon the first player positioning the first active first game piece on a board indicia on one of the designated positions, the first player obtaining a predetermined number of additional active first game pieces from the pool of inactive first game pieces.

20. The method of claim 1 wherein the step of the first player positioning includes upon the first player positioning the first active first game piece on a board indicia on one of the designated positions, the first player reducing the number of active second game pieces of the second player.

21. The method of claim 20 wherein the step of the first player decreasing includes removing an active second game piece from the game board.

22. The method of claim 20 wherein the step of the first player decreasing includes removing an active second game piece from an active second game piece retainer of the second player.

23. An interactive game that is played using the method of claim 1.

24. A method for playing an interactive game between a plurality of players including a first player and a second player, the method comprising the steps of:

the first player obtaining a plurality of active first game pieces that each includes a word-forming indicia;

the first player positioning a first active first game piece onto one of a plurality of designated positions of a game board to at least partially form a first word;

the second player indicating that the second player does not believe the first player can form any word with the first active first game piece and the remaining active first game pieces; and the first player choosing one of two steps to take, the steps including (i) the first player admitting that the first player cannot form any word with the first active first game piece and the remaining active first game pieces, and (ii) the first player positioning one or more of the remaining active first game pieces on the game board to completely form the first word.

25. A method for playing an interactive game between a plurality of players including a first player and a second player, the method comprising the steps of:

the first player obtaining a plurality of active first game pieces that each includes a word-forming indicia;

the first player positioning a first active first game piece onto one of a plurality of designated positions of a game board to at least partially form a first word; and the second player attempting to identify the first word; and the first player choosing one of two steps to take, the steps including (i) admitting the second player correctly identified the first word, and (ii) the first player positioning a second active first game piece on the game board adjacent to the first active first game piece to at least partially form a second word.

* * * * *